United States Patent [19]

Oka et al.

[11] Patent Number: 4,614,697

[45] Date of Patent: Sep. 30, 1986

[54] DEVELOPING METHOD FOR DEVELOPING ELECTROSTATIC LATENT IMAGE

[75] Inventors: Tateki Oka, Toyohashi; Yoshihiro Uchimoto, Habikino, both of Japan

[73] Assignee: Minolta Camera Kabushiki Kaisha, Osaka, Japan

[21] Appl. No.: 694,635

[22] Filed: Jan. 24, 1985

[30] Foreign Application Priority Data

Jan. 30, 1984 [JP] Japan ..... 59-16461

[51] Int. Cl.[4] ..... G03G 13/22

[52] U.S. Cl. ..... 430/103; 430/108; 430/137

[58] Field of Search ..... 430/103, 108, 109, 110, 430/137

[56] References Cited

U.S. PATENT DOCUMENTS 4,111,823 9/1978 Kobayashi et al. ..... 430/110

*Primary Examiner*—John L. Goodrow

*Attorney, Agent, or Firm*—Wenderoth, Lind & Ponack

[57] ABSTRACT

A developing method for developing electrostatic latent images with a toner and carrier particles in which particles as a third component are preliminarily mixed with the toner to be replenished, and rising in charge of the toner to be replenished into the developing material is accelerated, without generation of toner dust or scatter after the replenishment so as to be capable of being fully suitable for a high speed copying apparatus, while the charging characteristics of the carrier are not deteriorated even by the addition of the third component particles, with a favorable separation of copy paper sheets from an electrostatic latent image support member.

19 Claims, 8 Drawing Figures

DEVELOPING METHOD FOR DEVELOPING ELECTROSTATIC LATENT IMAGE

BACKGROUND OF THE INVENTION

The present invention generally relates to an electrographic process and more particularly, to a developing method for developing an electrostatic latent image carried on a surface of an electrostatic latent image support member.

Generally, for developing an electrostatic latent image formed on a photosensitive member into a visible image, a two-component developing material prepared by mixing carrier of iron particles, ferrite powder, etc. with toner has been widely employed for actual applications. The developing material of the above described type is employed in the developing by mixing and stirring the carrier particles and toner particles for electrostatic attraction therebetween through triboelectric charging prior to being supplied onto the electrostatic latent image (based, for example, on a cascade system, magnetic brush system, or the like).

In the above case, only the toner of the above developing material electrostatically adheres to the image portion of the electrostatic latent image so as to be consumed, and therefore, it is necessary to properly replenish toner corresponding to the consumption into the developing material. During the above replenishment, the supplied toner is required to be rapidly electrically charged to a predetermined amount of charge through contact thereof with the carrier, because dusting of the toner or scattering thereof takes place due to delay in the rising charge, thus resulting in soiling inside and outside the copying apparatus.

Therefore, in order to accelerate the rising electric charge of the toner, it there has conventionally been proposed to improve a developing material stirring mechanism, etc., but in the case where the amount of replenishment per unit of time is increased (particularly as in a high speed copying apparatus), it is difficult to achieve a sufficiently rapid rising charge.

Meanwhile, for solving the problem described above, it may be considered to triboelectrically charge the toner preliminarily to a predetermined polarity before the replenishment, and the present inventors have employed, on a trial basis, a method in which particles triboelectrically charged to a polarity opposite to that of the toner are preliminarily mixed into the replenishing toner, the result of which, however, has undesirably led to an increase in the dusting of toner. The above inconvenience is assumed to be attributable to the fact that within the developing tank, the toner and the particles added thereto tend to be triboelectrically charged to an opposite polarity with respect to each other through contact with the carrier, and consequently, the charging characteristics of the carrier become unstable, with a particular reduction in the charge amount of the carrier, thus making it impossible for the carrier to sufficiently hold the toner.

SUMMARY OF THE INVENTION

Accordingly, an essential object of the present invention is to provide a developing method for developing electrostatic latent images in which particles, as a third component, are preliminarily mixed with the toner to be replenished, and the rising charge of the toner to be replenished into the developing material is accelerated, without generation of toner dust or scattering after the replenishment, so as to be fully suited for use with a high speed copying apparatus, while the charging characteristics of the carrier are not deteriorated even by the addition of the third component particles, with a favorable separation of copy paper sheets from an electrostatic latent image support member.

Another important object of the present invention is to provide a developing method of the above described type which can be readily applied to electrographic processes and the like.

In accomplishing these and other objects, according to one preferred embodiment of the present invention, there is provided an improved developing method for developing an electrostatic latent image carrred on a surface of an electrostatic latent image support member. The developing method includes the steps of preparing a developing material by stirring a mixture of high resistance carrier, electrically insulative toner to be triboelectrically charged to a predetermined polarity through contact with the high resistance carrier, and electrically insulative particles with an average particle diameter of 8 to 20 μm which are smaller than the average particle diameter of the carrier, with the electrically insulative particles being arranged to be triboelectrically charged to a polarity opposite to the predetermined polarity through contact with the toner, but not to be substantially triboelectrically charged through contact with the carrier, and developing the electrostatic latent image by the developing material thus prepared so as to cause the toner to adhere to the surface corresponding to image portions of the electrostatic latent image on the electrostatic latent image support member, and to cause the electrically insulative particles to adhere to the surface corresponding to the non-image portions thereof.

More specifically, according to the present invention, owing to the fact that the toner is preliminarily charged to a polarity opposite to the charging polarity of the carrier within the developing tank by mixing the insulative particles with the toner in advance, the rising in the charge of the replenished toner may be expedited. Meanwhile, by selecting particles not substantially triboelectrically charged through contact thereof with the carrier as the above insulative particles, the charging characteristics of the carrier are not deteriorated, and moreover, since the insulative particles adhere to non-image portions on the electrostatic latent image support member based on the relationship between their charge and a developing bias, separation of copy paper sheets from the electrostatic latent image support member may be facilitated. The insulative particles adhering to the non-image portions are removed by a cleaning device without being transferred to the copy paper sheet.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
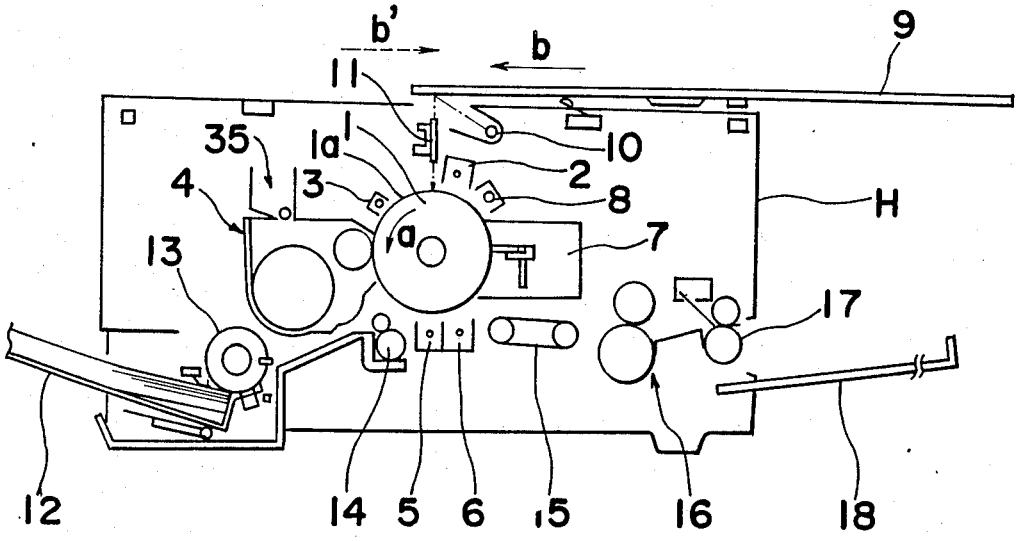
FIG. 1 is a schematic side elevational view of an electrographic copying apparatus employed for experiments on the developing method according to the present invention.

Before the description of the present invention proceeds, it is to be noted that like parts are designated by like reference numerals throughout the accompanying drawings.

Referring now to the drawings, an electrographic copying apparatus and a developing device thereof, by which various experiments are effected through employment of developing materials in EXAMPLES 1 through 3 to be described later, will be first explained hereinbelow.

As shown in FIG. 1, the electrographic copying apparatus is of an original document platform moving type slit exposure system, and includes a photosensitive or photoreceptor drum 1 having a photosensitive surface 1*a* formed on the outer peripheral surface thereof, and rotatably provided generally at a central portion of an apparatus housing H for rotation in a direction indicated by an arrow a, and various processing devices such as a corona charger 2, a sub-eraser lamp 3, a magnetic brush developing device 4, a transfer charger 5, an AC charger 6, a cleaning device 7, and an eraser lamp 8, etc. sequentially disposed around the photoreceptor drum 1 in a known manner.

At the upper portion of the apparatus housing H, there is movably provided an original document platform 9 for reciprocation in the directions indicated by arrows b and b', and an original document (not particularly shown) placed on the original document platform 9 is subjected to irradiation of light by an exposure lamp 10 provided below and adjacent to the platform 9 as the platform 9 is moved in the direction of the arrow b, while light reflected from the original document is projected in the form of slits onto the photosensitive surface 1*a* through an image transmitter array 11 formed of a plurality of graded index fibers in a bundled configuration. While being driven for rotation in the direction indicated by the arrow a, the photosensitive surface 1*a* of the photoreceptor drum 1 is first uniformly charged by the corona charger 2, and then, subjected to the image exposure through the image transmitter array 11 so as to be formed with an electrostatic latent image thereon corresponding to the image of the original document. The electrostatic latent image thus formed is developed by the developing device 4 into a visible toner image, and reaches the transfer section provided with the transfer charger 5.

Meanwhile, copy paper sheets accommodated in a paper feeding cassette 12 provided at the left side of the apparatus housing H in FIG. 1 is fed, one sheet by one sheet, by a paper feeding roller 13 from the top sheet of a stack, and is transported to the transfer section by timing rollers 14 in synchronization with the rotation of the photoreceptor drum 1. The copy paper sheet thus fed is transferred with the toner image on the photosensitive surface 1*a* of the photoreceptor drum 1 at the transfer section through discharge by the transfer charger 5, and is thereafter separated from the photoreceptor 1 by the function of the AC discharger 6 and resiliency of the copy paper sheet itself, and is further fed, through a transport belt 15, to a fixing device 16 where the toner image is fixed onto the copy paper sheet so as to be subsequently discharged onto a tray 18 through discharge rollers 17.

After the transfer, remaining toner is removed from the photoreceptor drum 1 by the cleaning device 7, while residual charge is also removed therefrom by the eraser lamp 8 to prepare for the subsequent copying process.

Figure 2:
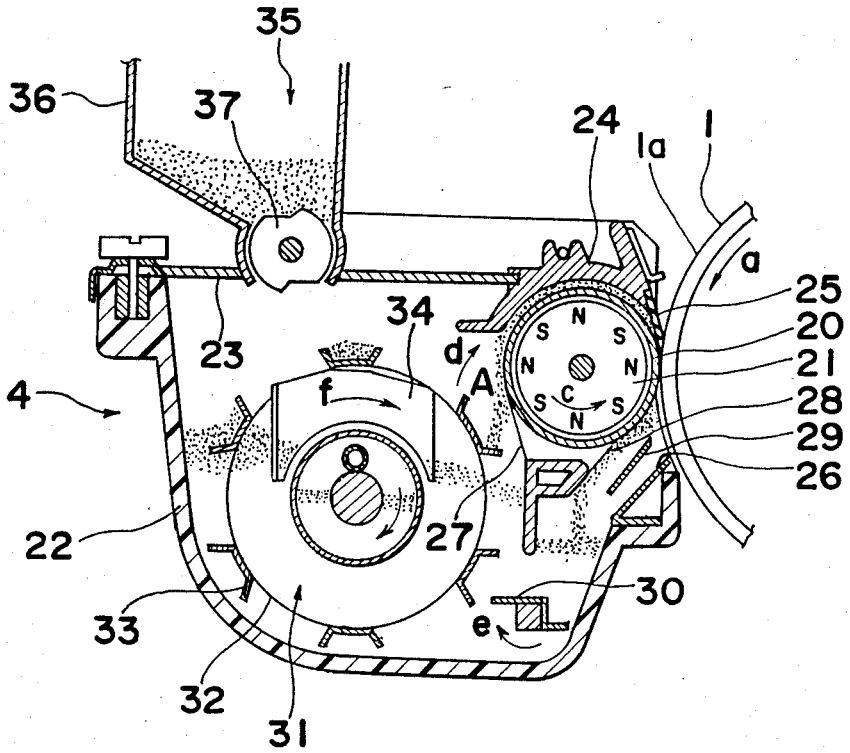
FIG. 2 is a fragmentary side sectional view showing, on an enlarged scale, a developing device employed in the copying apparatus of FIG. 1.

Referring particularly to FIG. 2, the developing device 4 will be described in detail hereinbelow.

The developing device 4 generally includes a casing 22, a developing sleeve 20 rotatably provided at the developing position, a magnet roller 21 also rotatably incorporated within the developing sleeve 20, and a bucket roller 31, etc., which are accommodated in the casing 22 functioning as a developing material storing tank, and a toner replenishing device 35 mounted on the casing 22. The developing sleeve 20 formed into a cylindrical configuration from a non-magnetic electrically conductive material such as aluminum or the like is adapted to be driven for rotation in a direction indicated by an arrow c at low speeds in a position close to the photosensitive surface 1*a* of the photoreceptor drum 1. Meanwhile, the magnet roller 21 is sequentially magnetized with N and S poles on its outer peripheral surface in a circumferential direction, and is capable of being driven at high speeds also in the direction of an arrow c. In other words, the developing material is subjected to moving forces in the direction of the arrow c through rotation of the developing sleeve 20, and in a direction opposite to the direction of the arrow c through rotation of the magnet roller 21, and consequently, moves over the surface of the developing sleeve 20 in the direction of the arrow d by a difference between the moving forces of both.

Above and adjacent to the developing sleeve 20 disposed at the upper right portion of the casing 22, there is provided a casing member 24 constituting a part of an upper casing 23, while at the forward end of the casing member 24 and on an extension of an arc of its inner peripheral surface, a flexible electrically insulative seal member 25 is provided so as to contact the photosensitive surface 1*a* of the photoreceptor drum 1.

Meanwhile, under the developing sleeve 20, there are provided a toner spilling prevention plate 26 secured to one edge of the casing 22, a cleaner 27 and a toner scraper 28 respectively provided to contact the surface of the developing sleeve 20 in a forward direction confronting the rotational direction of the sleeve 20 and also, in a reverse direction following the rotational direction of said sleeve 20, a developing material scattering prevention plate 29, and a transport vane 30 capable of being driven for rotation in the direction of the arrow e. The bucket roller 31 includes a plurality of troughs or buckets 33 having a U-shaped cross section and provided at equal intervals on end plates 32 thereof, with a stirring plate 34 being fixed to a reverse surface of one bucket 33, and is arranged to be driven for rotation in the direction of an arrow f so as to scoop up the developing material accommodated in the casing 22 by the buckets 33 for transportation thereof up to a position (A) close to the developing sleeve 20.

The toner replenishing device 35 provided on the upper casing 23 includes a toner tank 36 having a bottom portion opened into the interior of the casing 22, with a toner replenishing roller 37 being rotatably provided in the opening so that the replenishing amount of the toner may be controlled by controlling the rotating time of the roller 37.

Hereinbelow, EXAMPLES of the developing materials are inserted for the purpose of illustrating the present invention, without any intention of limiting the scope thereof.

EXAMPLE 1

The developing material is composed of 90 wt. % of high resistance magnetic carrier having an average particle diameter of 35 μm with a resistance value of $10^{13}$ Ωcm, and obtained by melting and mixing

| | |
|---|---|
| Styrene-acrylic polymer (HYMER-SBM73: name used in trade and manufactured by Sanyo Chemical Industries, Ltd. of Japan) | 100 parts by weight |
| Magnetic fine particles (MAGNETITE RB-BL: name used in trade and manufactured by Chitan Kogyo Kabushiki Kaisha of Japan) | 200 parts by weight |
| Carbon black (MA #100: name used in trade and manufactured by Mitsubishi Chemical Industries, Ltd. of Japan) | 4 parts by weight |

for subsequent cooling, mill and classification, and 10 wt. % of a replenishing agent prepared by preliminarily mixing non-magnetic electrically insulative toner (hereinafter referred to as toner A) having an average particle diameter of 12 μm with a resitance value of $10^{15}$Ωcm, and obtained by processing

| | |
|---|---|
| Styrene-acrylic polymer (PLIORITE AC: name used in trade and manufactured by Good Year Chemical Industries, Ltd. of Japan) | 100 parts by weight |
| Carbon black (MA #100 referred to above) | 8 parts by weight |
| Charge control dye (NYGROSINE: name used in trade and manufactured by Orient Chemical Industries, Ltd. of Japan) | 2 parts by weight |

in the similar manner as above, with electrically insulative particles (hereinafter referred to as particles A) having an average particle diameter of 12 μm with a resistance value of $10^{15}$Ωcm, and obtained by processing

| | |
|---|---|
| Styrene-acrylic polymer (HYMER-SBM73 referred to earlier) | 100 parts by weight |
| Magnetic fine particles (MAGNETITE RB-BL referred to earlier) | 10 parts by weight |

in the similar manner as above, at a weight ratio of toner A:particles A = 10:1.

It should be noted here that, in the preparation of the above developing material in EXAMPLE 1 and all the developing materials to be described later in other EXAMPLES, the mixture of the toner and the insulative particles is first stirred to form a mixture, and then, the resultant mixture is further mixed with the carrier by stirring, to thereby prepare the developing material.

In the developing material of EXAMPLE 1 including the respective particles as described above, the toner A is triboelectrically charged to the positive polarity through contact with the magnetic carrier, while the magnetic carrier is charged to the negative polarity. Although the particles A are triboelectrically charged to the polarity opposite to that of the toner A, i.e., to the negative polarity through contact with the toner A, they are not substantially triboelectrically charged through contact with the magnetic carrier.

More specifically, the substantial charge amount of the toner A and the charge amount of the particles A with respect to the magnetic carrier are respectively (+)15 μc/g, and (−)1.2 μc/g according to a film developing charge amount measuring method. The substantial charge amount of the toner A is measured by the film developing charge amount measuring method in which an electrically insulative film charged to a polarity opposite to the charging polarity of the toner A is developed by the developing material prepared by mixing the magnetic carrier, toner A, and insulative particles A described above.

Incidentally, the state where the insulative particles A are not substantially triboelectrically charged through contact thereof with the magnetic carrier may be defined based on the fact as follows.

More specifically, when the electrically insulative film is subjected to developing at the so-called film developing charge amount measuring in which the surface of said insulative film charged to the polarity opposite to that of the triboelectric charging polarity of the particles A (i.e., the triboelectric charging polarity of the particles A with respect to the magnetic carrier) is developed by the mixture of the particles A and the magnetic carrier sufficiently mixed and stirred, an absolute value of the charge amount of the particles as measured by a method for measuring the charge amount of said particles from the amount of the lowering of the surface potential of the insulative film and the amount of adhesion of the particles onto the surface of the insulative film, is less than 2.0 μc/g and more preferably, 1.0 μc/g.

However, in the case where the charge amount of the particles is very small, the adhesion of the particles onto the insulative film surface does not take place, and thus, it becomes impossible to measure the charge amount itself of the particles, and the absence of the adhesion as described above means nothing but the non-charging of the particles.

EXAMPLE 2

The developing material is composed of 10 wt. % of a replenishing agent prepared by preliminarily mixing the toner A in EXAMPLE 1, with electrically insulative particles (referred to as the particles $A_1$, hereinbelow) similar to the particles A in EXAMPLE 1, only the average particle diameter of which is reduced to 8 μm, at a weight ratio of 10:1, and 90 wt. % of the magnetic carrier in EXAMPLE 1.

It is to be noted here that the substantial charge amount of the toner A with respect to the magnetic carrier and the charge amount of the particles $A_1$ in EXAMPLE 2 are respectively (+)15 μc/g and (−)1.4 μc/g according to the film developing charge amount measuring method.

Comparative Data 1

The developing material is composed of 10 wt. % of a replenishing agent prepared by preliminarily mixing the toner A in EXAMPLE 1, with electrically insulative particles (hereinbelow referred to as the particles B) similar to the particles A in EXAMPLE 1, only the average particle diameter of which is further reduced to 4 μm, at a weight ratio of 10:1, and 90 wt. % of the magnetic carrier in EXAMPLE 1.

It is to be noted here that the substantial charge amount of the toner A with respect to the magnetic carrier and the charge amount of the particles B in the Comparative Data 1 are respectively (+)12 μc/g and (−)1.7 μc/g according to the film developing charge amount measuring method.

Hereinbelow, copying experiments carried out on the developing device 4 referred to earlier with reference to FIG. 2 through employment of the developing materials of EXAMPLES 1 and 2 will be described.

For effecting the above copying experiments, the replenishing agent prepared by preliminarily mixing the toner A with the particles A (or particles $A_1$) at a weight mixing ratio of 10:1 was accommodated in the toner tank 36, while the developing material prepared by mixing in advance the magnetic carrier and the replenishing agent at a weight mixing ratio of 9:1 was contained in the developing casing 22.

Meanwhile, the charge potential Vo of the photoreceptor drum 1 (i.e., potential at the image portion) was set at −600 V and the potential Vi at the exposed portion (i.e., potential at the non-image portion) was set at −150 V, with the developing bias potential Vb to be applied to the developing sleeve 20 being set at −300 V.

Figure 3A:
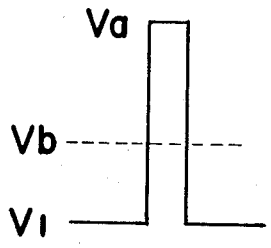
FIGS. 3(*a*) and 3(*b*) are diagrams explanatory of development by the developing material employed in the developing method according to the present invention.
Figure 3B:
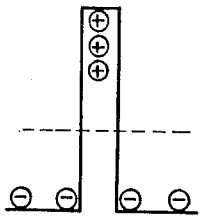

In the above case, it has been ensured that the toner A adheres to the image portion having the potential of −600 V, while the particles $A(A_1)$ adhere to the non-image portion having the potential of −150 V as shown in FIG. 3(*b*), owing to the fact that the toner A is triboelectrically charged to the positive polarity, and the particles $A(A_1)$ to the negative polarity as described earlier. In the transfer process, the toner A adhering to the image portion is transferred onto the copy paper sheet by the discharging phenomenon of the transfer charger 5 referred to earlier. Meanwhile, the particles $A(A_1)$ adhering to the non-image portion are not transferred onto the copy paper sheet, since they have the charge of the same polarity as the discharging polarity of the transfer charger 5, and are removed from the photosensitive surface 1*a* of the photoreceptor drum 1 together with the residual toner A by the cleaning device 7.

With respect to separation of the copy paper sheet from the photoreceptor drum 1, an extremely superior separating performance was observed. This may be attributable to the fact that the particles $A(A_1)$ adhering to the non-image portion act, as it were, as a spacer between the copy paper sheet and the photoreceptor drum 1, thus reducing attraction of the copy paper sheet to the photoreceptor drum 1. Particularly, with respect to the above separating performance, separation at the leading edge of the copy paper sheet is brought into question, but normally, no images are to be formed at the leading edge of the copy paper sheet, and by the adhesion of the particles $A(A_1)$ at such portion, the separating performance is markedly improved.

Figure 4:
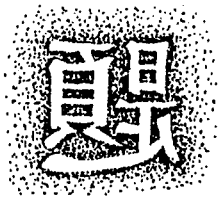
FIG. 4 is a schematic diagram showing the state of a photosensitive surface after the transfer.

On the other hand, FIG. 4 represents the condition where the particles $A(A_1)$ are adhering to the non-image portions, and schematically shows the state achieved in such a manner as effecting the developing by the developing material of EXAMPLE 1, applying a transparent adhesive tape onto the surface of the photoreceptor drum after the transfer so as to move the material adhering to the photoreceptor drum onto the adhesive surface of the transparent tape, and subsequently, observing the material on the adhesive surface by a microscope. In FIG. 4, a Japanese character "dai" (meaning a title) has a size of $3.5\times3.5$ mm$^2$, and since this is the state after transfer, the toner A has already been transferred onto the copy paper sheet to leave the image portions fully white, with the particles A adhering to the non-image portion, particularly at edge portions of the image.

Incidentally, when the copying experiment was effected by the developing device 4 through employment of the developing material of the Comparative Data 1, the particles B to the non-image portion were extremely reduced. This is ascribed to the fact that due to the small average particle diameter of the particles B at 4 μm, coulomb force between the toner A and the particles B is relatively increased, and the particles B are caused to adhere to the image portion, as they are adhering to the toner A. Accordingly, by the above copying experiment, no improvement in the separating performance of the copy paper sheet from the photoreceptor drum 1 was noticed. This may be attributable to the fact that the particles B do not adhere much to the non-image portion, and even if they adhere thereto, such particles B do not function as a spacer as in the particles $A(A_1)$ described earlier owing to their small average particle diameter, without inviting any reduction of attraction of the copy paper sheet onto the photoreceptor drum 1.

Accordingly, in order to cause the electrically insulative particles to adhere to the non-image portion on the photosensitive member for displaying a favorable separating performance of copy paper sheets, it is necessary that the electrically insulative particles have the average particle diameter larger than 8 μm. However, it can not be said at all times that any average particle diameters larger than 8 μm will serve the purpose, and if the average particle diameter exceeds 20 μm, the transfer characteristic of the toner is deteriorated, thus resulting in the disturbance of the transferred image, owing to the fact that if the electrically insulative particles are excessively large in diameter, the space between the copy paper sheet and the photoreceptor drum 1 becomes too large conversely, and the electric field by the transfer charger 5 does not sufficiently act on the toner.

Therefore, it is preferable that the average particle diameters of the insulative particles should be larger than 8 μm and smaller than 20 μm (so as not to be excessively large as compared with the average particle diameters of the toner or so as to be smaller than the average particle diameters of the toner). By way of example, the average particle diameters of the toner are normally in the range of 5 to 20 μm.

Meanwhile, in the case where the developing materials of EXAMPLES 1 and 2 were employed, rising in the charging of the toner A was favorable, without generation of the toner dust, toner scatter, etc. in the developing device 4. The developing material of the Comparative Data 1 showed results generally the same as above, although a slight fogging of toner is noticed on the copied images due to the small substantial charge amount of the toner, with the image quality being rather inferior to that in the developing materials of EXAMPLES 1 and 2.

In order to ensure the above points more specifically, 450 g of the magnetic carrier and 50 g of the replenishing agent of EXAMPLE 1 were placed in the developing device 4 without mixing for effecting the copying function, and as a result, generation of the toner dust, toner scatter, etc. was not noticed. The result was similar to the above even when the replenishing agent was replaced by that of EXAMPLE 2. Moreover, for comparison, without the particles A ($A_1$) being dispensed with, 450 g of the magnetic carrier and 50 g of the toner A were placed in the developing device 4 without mixing for effecting the copying function. In the above case, generation of the toner dust and toner scatter was noticed, with a consequent soiling in the interior of the copying apparatus, but in a short time after starting of the developing device 4, generation of the toner dust and toner scatter was stopped.

The foregoing results are considered to be attributable to reasons as follows.

Specifically, in the mixing and stirring of the toner A and the particles A ($A_1$) at the state for preparing the replenishing agent, the toner A is charged to the positive polarity and the particles A ($A_1$) to the negative polarity due to the triboelectric charging characteristics thereof. When the replenishing agent thus prepared is mixed and stirred together with the magnetic carrier within the developing device, the toner A is further charged through contact thereof with the magnetic carrier, and acquires a sufficient charge owing to the charge preliminarily possessed thereby, even if the degree of contact with the magnetic carrier is small, and thus, held in the magnetic carrier through coulomb force. In other words, the toner A can acquire a sufficient amount of charge, even when ample stirring is not effected within the developing device.

However, in the above Comparative Data 1, the toner A which does not preliminarily possess any charge is to be mixed for stirring with the magnetic carrier in the developing device, and in this case, the toner A does not acquire a sufficient amount of charge in the state where the degree of contact thereof with the magnetic carrier is small, and therefore, cannot be stably held in the magnetic carrier by the coulomb force, thus resulting in the generation of the toner dust and toner scatter at the initial stage of stirring.

By continuing the stirring, it becomes possible for the toner to have a sufficient charge, and the undesirable generation of toner dust, toner scatter, etc., may be eliminated.

For ensuring such assumption as above, an experiment as follows was carried out.

Two kinds of developing materials, i.e.,

| | | |
|---|---|---|
| (a) | magnetic carrier | 135 g |
| | replenishing agent (EXAMPLE 1) | 15 g |
| (b) | magnetic carrier | 135 g |
| | toner A | 15 g |

were prepared, loaded into the tank having a capacity of 200 cc, and subjected to mixing and stirring, with the mixing and stirring means being rotated at 100 rpm, and thus, the substantial charge amount of the toner A was measured by the film developing charge amount measuring method.

Figure 5:
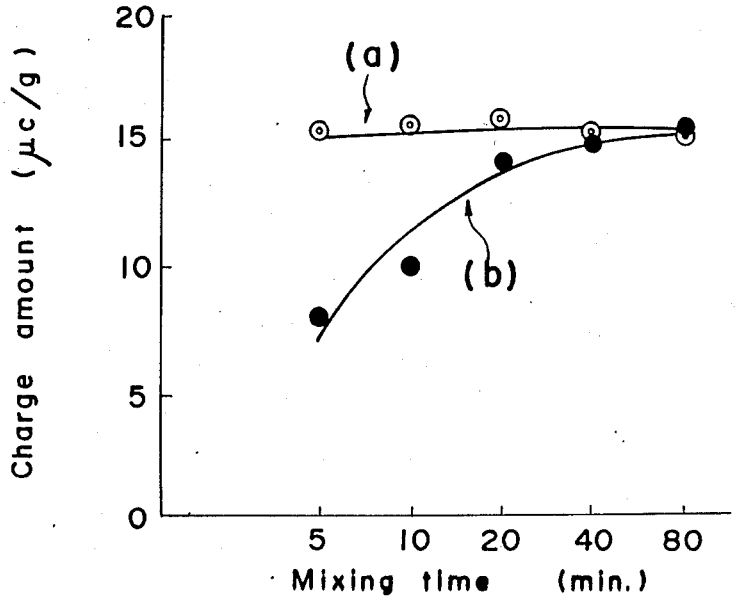
FIG. 5 is a graph showing charge rising characteristics of toner.

In a graph of FIG. 5, there is shown the result of the above experiment, in which a curve (a) represents the variation of the charge amount of the toner A with respect to the mixing time for the above developing material (a), while a curve (b) shows that for the developing material (b). As is clear from FIG. 5, the developing material (a) has the better characteristic in the rising of the toner charging.

Subsequently, upon effecting an experiment by changing the mixing ratio of the toner A to the particles A in the replenishing agent, results as in the following table were obtained.

| Mixing Ratio Toner A:Particles B | Charge Rising Rate (%) | Excessive Remaining of Particles A in the Developing Tank | Evaluation |
|---|---|---|---|
| 30:1 | 73 | None | X |
| 20:1 | 90 | None | O |
| 10:1 | 99 | None | O |
| 5:1 | 100 | None | O |
| 3:1 | 98 | Present | O |
| 1:1 | 102 | Present | O |
| 1:0 | 52 | — | X |

In the above table, the charge rising rate is the value obtained by dividing the substantial charge amount of the toner A upon mixing and stirring the developing material for five minutes, by the substantial charge amount of the toner A during stabilization after mixing and stirring for a long period of time. In the evaluation of the above table, the charge rising rate over 80% is represented by a symbol O. Meanwhile, the excessive remaining of the particles A refers to a case where the image density is lowered by effecting the developing for a long period. The excessive remaining of the particles A within the developing tank is considered to be attributable to the fact that the ratio of the particles A in the replenishing agent is so high that the particles A are not fully consumed (i.e., the particles A are still excessive even if they are adhering to the non-image portion).

Accordingly, from the above results of the experiment, the mixing ratios of the toner A to the particles A in the replenishing agent should preferably be in the range of 20:1 to 5:1 in a weight ratio as marked with the symbol O in the evaluation column of the above table.

EXAMPLE 3

The developing material is composed of 10 wt % of a replenishing agent prepared by preliminarily mixing the toner A in EXAMPLE 1 with electrically insulative particles (referred to as particles $A_2$ hereinbelow) having an average particle diameter of 11 μm and a resistance value of $10^{15}$ Ωcm, and obtained by processing

| | |
|---|---|
| Styrene-acrylic polymer (HYMER-SBM73 referred to earlier) | 100 parts by weight |
| Carbon black (MA #100 referred to earlier) | 4 parts by weight |

in the similar manner as in EXAMPLE 1, at a weight ratio of toner A:particles $A_2$=10:1 with 90 wt % of the magnetic carrier in EXAMPLE 1.

It is to be noted here that the substantial charge amount of the toner A with respect to the magnetic carrier and the charge amount of the particles $A_2$ in EXAMPLE 3 are respectively (+)15 μc/g and (−)0.9 μc/g according to the film developing charge amount measuring method.

EXAMPLE 4

The developing material is composed of 10 wt % of a replenishing agent prepared by preliminarily mixing the toner A in EXAMPLE 1 with electrically insulative particles (referred to as particles $A_3$ hereinbelow) having an average particle diameter of 11 μm and a resistance value of $10^{14}$ Ωcm, and obtained by processing

| | |
|---|---|
| Styrene-acrylic polymer (HYMER-SBM73 referred to earlier) | 150 parts by weight |
| Magnetic fine particles (MAGNETITE RB-BL referred to earlier) | 100 parts by weight |

in the similar manner as in EXAMPLE 1, at a weight ratio of toner A:particles $A_3$=10:1 with 90 wt % of the magnetic carrier in EXAMPLE 1.

It is to be noted here that the substantial charge amount of the toner A with respect to the magnetic carrier and the charge amount of the particles $A_3$ in EXAMPLE 4 are respectively (+)15 μc/g and (−)0.8 μc/g according to the film developing charge amount measuring method.

As a result of experiments carried out on the developing device 4 in a similar manner as before through employment of the developing material of the above EXAMPLES 3 and 4, the rising of the charge of toner A was as quick as that in EXAMPLES 1 and 2, without generation of toner dust, toner scatter, etc., and the charging stability of the magnetic carrier was favorable, with superior separation of the copy paper sheet from the photoreceptor drum 1, and of course, adhesion of the particles $A_2$ and $A_3$ onto the non-image portion was noticed.

EXAMPLE 5

The developing material is composed of 90 wt % of high resistance magnetic carrier having a resistance value higher than $10^8$ Ωcm and an average particle diameter of 33 μm prepared by mixing 3,000 g of a mixture of

| | |
|---|---|
| Ferric oxide (average particle diameter 0.5 μm) | 100 parts by weight |
| Zinc oxide (average particle diameter 0.1 μm) | 40 parts by weight |
| Nickel oxide (average particle diameter 13 μm) | 17 parts by weight |

with 1,195 g of water for formation into a slurry, adding to the slurry, 98 g of 25 wt % aqueous solution of sodium methacrylate (Darvan 7: name used in trade and manufactured by R. T. Vanderbilt Company of U.S.A.) for mixing, thereafter spraying the mixture by an atomizer for drying and calcination thereof for two hours at a temperature of 1,190° C. in air to produce ferrite [Compositions: $(NiO)_{0.3}(ZnO)_{0.7}(Fe_2O_2)_{0.85}$] with a subsequent classification thereof, and 10 wt % of a replenishing agent prepared by preliminarily mixing magnetic toner (referred to as toner B hereinafter) having an average particle diameter of 12 μm and a resistance value of $10^{14}$ Ωcm, and obtained by melting and mixing

| | |
|---|---|
| Styrene-acrylate polymer (PLIORITE AC referred to earlier) | 100 parts by weight |
| Magnetic fine particles (MAGNETITE RB-BL referred to earlier) | 80 parts by weight |
| Carbon black (MA #100 referred to earlier) | 4 parts by weight |
| Charge control dye (NYROSINE referred to earlier) | 2 parts by weight |

for subsequent cooling, mill and classification, with the electrically insulative particles A in EXAMPLE 1, at a weight ratio of toner B:particle A=10:1.

In the developing material of EXAMPLE 5 including the respective particles as described above, the toner B is triboelectrically charged to the positive polarity through contact with the magnetic carrier, while the magnetic carrier is charged to the negative polarity. Although the particles A are triboelectrically charged to the polarity opposite to that of the toner B, i.e., to the negative polarity through contact with the toner B, of course, they are not substantially triboelectrically charged through contact with the magnetic carrier.

More specifically, the substantial charge amount of the toner B and the charge amount of the particles A with respect to the magnetic carrier are respectively (+)8.5 μc/g, and (−)1.2 μc/g according to a film developing charge amount measuring method.

Figure 6:
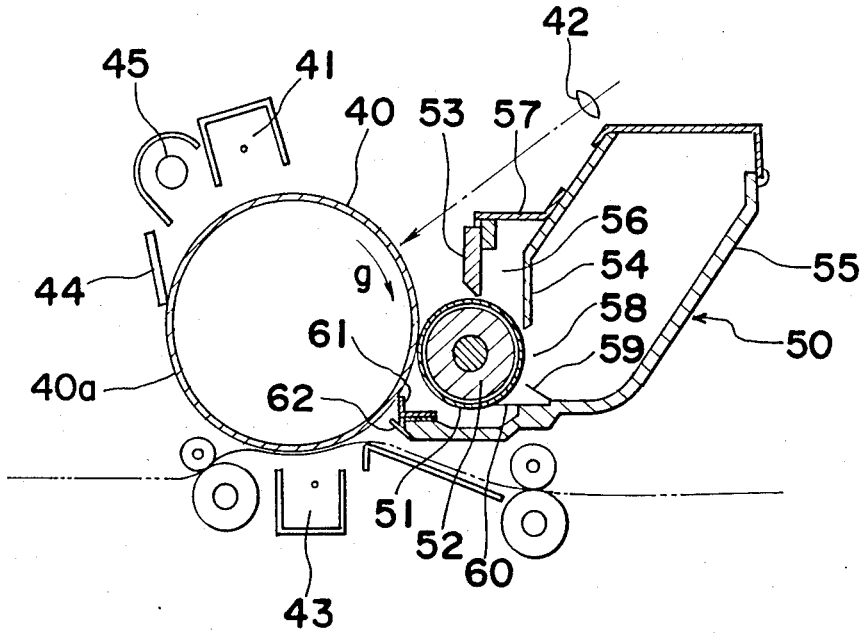
FIG. 6 is a fragmentary side sectional view of another electrographic copying apparatus employed in an experiment with the developing method according to the present invention.
Figure 7:
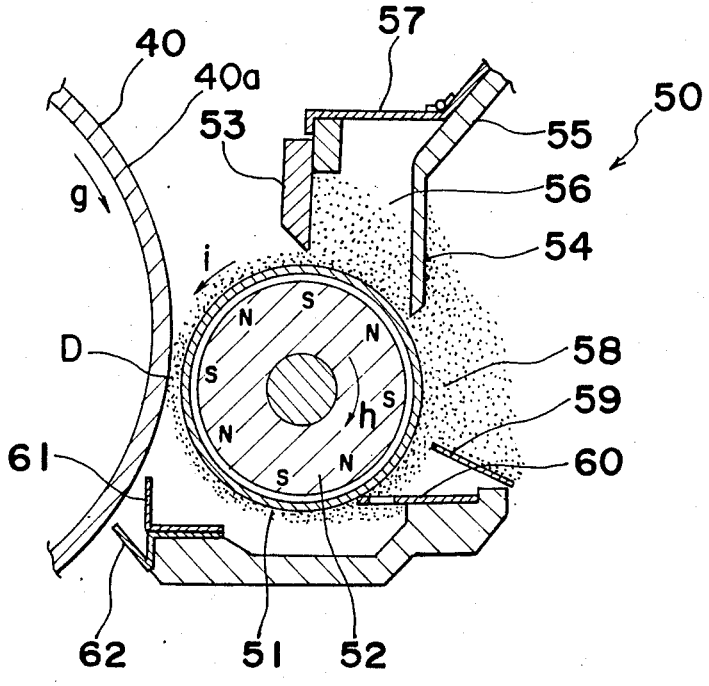
FIG. 7 is a fragmentary side sectional view, showing on an enlarged scale, a developing device employed in the copying apparatus of FIG. 6.

Referring particularly to FIGS. 6 and 7, the electrographic copying apparatus and developing device thereof, by which various experiments were carried out through employment of the developing material of EXAMPLE 5, will be described hereinbelow.

The electrographic copying apparatus of FIG. 6 generally includes a photoreceptor drum 40 having a photosensitive surface 40*a* on the outer peripheral surface thereof, and rotatably provided so as to be driven for rotation in a direction indicated by an arrow g at a constant speed, and various processing devices such as a corona charger 41, an image exposure means 42, a developing device 50, a transfer charger 43, a cleaning blade 44 for removal of remaining toner, and an eraser lamp 45 for erasing residual charge, etc., which are disposed around the photoreceptor drum 40 in the similar manner as in the copying apparatus of FIG. 1. Meanwhile, as shown by a two-dotted chain line, the copy paper sheets are arranged to be transported from the right side towards the left side in FIG. 6, and after transfer, discharged out of the copying apparatus through a fixing device (not shown).

As shown in FIG. 7, the developing device 50 includes a developing sleeve 51 formed into a cylindrical shape by a non-magnetic electrically conductive material and rotatably provided at the developing position, and a magnet roller 52 sequentially magnetized with N and S poles on its circumferential surface, and coaxially and rotatably accommodated in said developing sleeve 51, with a bristle height restricting plate 53 for the magnetic brush being provided in a position above and adjacent to the surface of said developing sleeve 51. Based on the rotation of the magnet roller 52 in the direction of an arrow h and that of the developing sleeve 51 in the direction of an arrow i, the developing material is transferred for circulation in the direction of the arrow i over the outer peripheral surface of the developing sleeve 51. Moreover, at the upstream side of the bristle height restricting plate 53, there is disposed a front restricting plate 54, which is integrally formed with a housing member of a toner replenishing tank 55, with the forward edge of the plate 54 confronting the outer peripheral surface of the developing sleeve 51. Between the bristle height restricting plate 53 and the front restricting plate 54, there is defined a space chamber 56, and an upper opening of the chamber 56 is provided with a movable cover plate member 57 for selective opening and closing of said upper opening, while a lower opening thereof is directed towards the outer peripheral surface of said developing sleeve 51.

On the other hand, the lower portion of the toner replenishing tank 55 is formed into a toner replenishing portion 58 open at the upstream side of the front restricting plate 54, and at the lower portion of said toner replenishing portion 58, a replenishing tank bottom portion forming plate 59 is disposed, while a perforated scraper 60 is so provided as to contact under pressure the outer peripheral surface of the developing sleeve 51 along the so-called forward direction. Furthermore, at the lower edge of the toner replenishing tank 55 and below the developing region D, developing material spilling prevention plates 61 and 62 are provided.

In the developing device 50 having the construction as described so far, the carrier is first supplied into the space chamber 56 by opening the cover plate member 57 and upon operation of the developing device 50, is placed on the outer peripheral surface of the developing sleeve 51. In the above case, the replenishing agent may be preliminarily mixed to a certain extent in the carrier. The replenishing agent is subsequently accommodated in the replenishing tank 55 so as to be fed onto the outer peripheral surface of the developing sleeve 51 through the replenishing portion 58. Based on the rotation of the magnet roller 52 in the direction of the arrow h or the rotation of the developing sleeve 51 in the direction of the arrow i, the replenishing agent is transported for circulation in the direction of the arrow i over the outer peripheral surface of the developing sleeve 51 so as to be stirred and mixed with the carrier as it passes through the space chamber 56, and the toner B is further charged to the positive polarity through triboelectric charging with respect to the carrier. As a matter of fact, the developing is effected under the state where the replenishing agent and the carrier are fully mixed with each other, and at the developing region D, the electrostatic latent image on the photosensitive surface 40*a* of the photoreceptor drum 40 is developed through adhesion of the toner B onto the image portion and the particles A onto the non-image portion. Of course, the toner B is transferred onto the copy paper sheet, while the particles A are removed by the cleaning blade 44 without being subjected to transfer.

The replenishing agent after the developing is further transported through holes of the perforated scraper 60 in the direction of the arrow i together with the carrier, and replenished with a fresh replenishing agent at the toner replenishing portion 58 so as to be once collected in the space chamber 56 for stirring and mixing, and again reaches the developing region D.

In the developing experiment as described so far, it was possible to continuously obtain, a favorable copied image, with a superior separating performance of the copy paper sheets from the photoreceptor drum. Particularly, even immediately after replenishment of a fresh replenishing agent into the toner replenishing tank 55, there was no generation of toner dust and toner scatter, thus providing copied images in a favorable quality.

As is clear from the foregoing description, according to the developing method of the present invention, the developing material employed therefor includes, as a mixture, the high resistance carrier, electrically insulative toner to be triboelectrically charged to a predetermined polarity through contact with the high resistance carrier, and electrically insulative particles with an average particle diameter larger than 8 μm which are to be triboelectrically charged to a polarity opposite to the triboelectrically charged polarity of the toner through contact with said toner, but which are not substantially triboelectrically charged through contact with the carrier, and therefore, by preliminarily mixing the toner with the electrically insulative particles, the toner is to be charged to a polarity opposite to the charged polarity of the carrier, and by replenishing the replenishing agent thus preliminarily mixed, into the developing tank, the rising in charge of the toner through contact thereof with the carrier may be accelerated, thus preventing generation of toner dust and toner scatter. Moreover, since the above insulative particles are those not substantially triboelectrically charged through contact thereby with the carrier, the charging characteristics of the carrier are not impaired, and there is no inconvenience that the carrier becomes incapable of sufficiently holding the toner. Furthermore, owing to the fact that these insulative particles are separated from the toner at the developing electric field, and also, consumed through adhesion to the non-image portion of the electrostatic latent image support member by the application of a normal developing bias, there is no possibility that the ratio thereof becomes unbalanced within the developing tank, or that the particles are not transferred onto the copy paper sheets at the transfer process, and therefore, the copied images are free from any adverse effect thereby. Additionally, during the separation of the copy paper sheet from the electrostatic latent image support member, the insulative particles adhering to the non-image portion function as a spacer, with a consequent improvement of the separating performance of the copy paper sheet.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A developing method for developing an electrostatic latent image carried on a surface of an electrostatic latent image support member, said developing method comprising the steps of:

(a) preparing a developing material by stirring a mixture of high resistance carrier, electrically insulative toner to be triboelectrically charged to a predetermined polarity through contact with said high resistance carrier, and electrically insulative particles with an average particle diameter of 8 to 20 μm which are smaller than an average particle diameter of said carrier, (b) triboelectrically charging said electrically insulative particles to a polarity opposite that of said predetermined polarity through contact with said toner, but said electrically insulative particles not being substantially triboelectrically charged through contact with said carrier, and (c) developing the electrostatic latent image by said developing material thus prepared so as to cause said toner to adhere to the surface corresponding to image portions of the elctrostatic latent image on the electrostatic latent image support member, and to cause said electrically insulative particles to adhere to the surface corresponding to non-image portion thereof, the adherence of said electrically insulative particles to said non-image portion being caused by the application of a bias voltage in proximity thereto.

2. A developing method as claimed in claim 1, wherein said developing material is prepared in said developing material preparing step in such a manner that a mixture of said toner and said electrically insulative particles is first mixed and stirred, with a mixture of the resultant mixture thus prepared and said carrier being further mixed and stirred to prepare said developing material.

3. A developing method as claimed in claim 1, further including the step of repeating said developing step while supplying a replenishing developing material prepared by the mixture of said toner and said electrically insulative particles into said developing material.

4. A developing method as claimed in claim 1, wherein said carrier has an electrical resistance value higher than $10^7$ Ωcm.

5. A developing methcd as claimed in claim 1, wherein said carrier has an electrical resistance value higher than $10^8$ Ωcm.

6. A developing method as claimed in claim 1, wherein an absolute value of the charge amount of the electrically insulative particles with respect to said carrier is less than 2.0 μc/g.

7. A developing method as claimed in claim 1, wherein an absolute value of the charge amount of the electrically insulative particles with respect to said carrier is less than 1.0 μc/g.

8. A developing method as claimed in claim 1, wherein said carrier has an average particle diameter in the range of 20 to 90 μm.

9. A developing method as claimed in claim 8, wherein said toner has an average particle diameter in the range of to 20 μm.

10. A developing method as claimed in claim 9, wherein said electrically insulative particle has an average particle diameter smaller than the average particle diameter of said toner.

11. A developing method as claimed in claim 1, wherein a mixing ratio of the toner to the electrically insulative particles in said developing material is in the range of 20:1 to 5:1 (toner:electrically insulative particles) in a weight ratio.

12. A developing method as claimed in claim 1, wherein said carrier is a magnetic carrier.

13. A developing method as claimed in claim 12, wherein said electrically insulative particles are magnetic particles.

14. A developing method as claimed in claim 12, wherein said electrically insulative particles are non-magnetic particles.

15. A developing method as claimed in claim 12, wherein a magnetic brush of the developing material is formed in said developing step so as to develop the electrostatic latent image by rubbing against the surface of the electrostatic latent image support member with bristles of said magnetic brush.

16. A developing method as claimed in claim 1, further including the step of selectively transferring only the toner adhering to the surface of the electrostatic latent image support member, onto the surface of a transfer paper.

17. A developing method as claimed in claim 1, wherein said toner and said electrically insulative particles have the same main compositions.

18. The developing method according to claim 17 wherein the insulative particles are mainly composed of thermoplastic resin.

19. The developing method according to claim 1 wherein the insulative particles are mainly composed of thermoplastic resin.

* * * * *